US007285006B1

(12) United States Patent
Daily et al.

(10) Patent No.: US 7,285,006 B1
(45) Date of Patent: Oct. 23, 2007

(54) SPRING-CLAMP STYLE CONTACT FOR PCB TO TERMINATE SOLAR PANEL TABBING

(75) Inventors: Christopher G Daily, Harrisburg, PA (US); Scott Duesterhoeft, Etters, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/548,934

(22) Filed: Oct. 12, 2006

(51) Int. Cl.
*H01R 11/20* (2006.01)

(52) U.S. Cl. ..... 439/441

(58) Field of Classification Search ..... 439/441, 439/81, 947, 76.1
See application file for complete search history.

(56) References Cited

U.S. PATENT DOCUMENTS

| | | | | |
|---|---|---|---|---|
| 4,422,128 | A | 12/1983 | Zurlinden et al. | |
| 4,557,544 | A * | 12/1985 | Esser | 439/391 |
| 4,566,749 | A * | 1/1986 | Johnston | 439/441 |
| 4,673,232 | A * | 6/1987 | Kubota et al. | 439/441 |
| 5,424,918 | A | 6/1995 | Felps et al. | |
| 5,711,687 | A | 1/1998 | Kuiper-Moore et al. | |
| 6,074,242 | A * | 6/2000 | Stefaniu et al. | 439/441 |
| 6,080,008 | A * | 6/2000 | Frantz | 439/441 |
| 6,336,814 | B1 * | 1/2002 | Kusyk et al. | 439/61 |
| 6,464,547 | B2 | 10/2002 | Ketelsleger | |
| 6,719,581 | B2 * | 4/2004 | Kikuchi | 439/441 |
| 6,890,192 | B2 * | 5/2005 | Riku | 439/108 |
| 6,911,602 | B2 * | 6/2005 | Conrad | 174/68.2 |
| 6,926,541 | B2 | 8/2005 | Takeuchi et al. | |
| 7,046,516 | B2 | 5/2006 | Lee et al. | |
| 7,150,646 | B2 * | 12/2006 | Trumper | 439/441 |
| 7,175,469 | B1 * | 2/2007 | Daily et al. | 439/441 |

* cited by examiner

*Primary Examiner*—Tulsidas C. Patel
*Assistant Examiner*—Harshad C Patel

(57) ABSTRACT

A spring clip modular assembly for a printed circuit board that has a solderless connection with a junction box. The assembly allows for easier and more efficient removal and replacement of the printed circuit board and electrical components while meeting the IEC 61215 second edition temperature standards. In addition, the spring clip is configured to reduce the amount of normal force applied to the printed circuit board when wire tabbing is inserted into the clips.

17 Claims, 7 Drawing Sheets

SPRING-CLAMP STYLE CONTACT FOR PCB TO TERMINATE SOLAR PANEL TABBING

BACKGROUND OF THE INVENTION

The present invention is directed to an improved system and method for securing electronics in a junction box while meeting industry temperature standards. More specifically, the present invention is directed to a printed circuit board that is secured in a junction box with a solderless connection with spring clips mounted thereon.

Most commonly, junction boxes employ electronic rails to which the electronics are soldered thereon creating a semi permanent connection that makes replacement of the parts difficult. Another issue with the current systems is the fragility of the electronics disposed in the junction boxes. The electronic components are unable to sustain the forces of inserting wire tabbing into the connections within the junction box. Often times the electronics are damaged or the solder connections are broken from the force of repeatedly inserting and removing the wire tabbing into the junction box. In addition, the current systems cannot dissipate heat in compliance with the newest standard of the International Electrotechnical Commission, standard 61215, second edition (hereinafter referred to as "IEC 61215").

One current system redesigned the typical junction box by adding a second capsule around the body section of the entire contact body to help remedy the issue of the force when inserting the wire tabbing. The second capsule provides extra support and strength to withstand the normal force from inserting the wire tabbing into the junction box when making an electrical connection. However, this system requires more materials for manufacture, is more expensive and requires a longer assembly time.

Other current methods eliminate the second outer capsule discussed above, where the junction box is constructed of material strong enough to withstand the normal force applied during insertion of the wire tabbing. However, in order to maintain a solid connection with the wire tabbing, these systems require the aid and use of tools, soldering, or other equipment to initiate the connection with the wire tabbing. The use of the tools and equipment to make the connection is time consuming, as well as expensive. In addition, often times, these tool connections are permanent and prevent the replacement of any of the components.

Thus, what is needed is a method and system to provide a junction box with solderless connections and electronic equipment that is configured with a receptacle that is capable of receiving wire tabbing and strong enough to withstand the normal force of insertion. A system that allows for easy repairs and replacement when necessary to reduce time and costs is needed as well.

SUMMARY OF THE INVENTION

One embodiment of the present invention includes

Another embodiment of the present invention includes.

Yet another embodiment of the present invention

One advantage of the present invention is the lower manufacturing costs, and no maintenance costs for the system.

Another advantage of the present invention is improved junction box performance with improved cooling means of the electrical components.

Yet another advantage of the present invention is improved replaceability functionality.

Another advantage of the present invention is that no tools or equipment are necessary to electrically connect the wire tabbing in the spring clip.

Yet another advantage of the present invention is that no support apparatuses are required for the clip.

Another advantage of the present invention is high termination retention of the spring clips.

Yet another advantage of the present invention is low insertion force applied during termination of the wire tabbing into the spring clip.

Yet another advantage of the present invention is that the components and contacts can be wave soldered onto the printed circuit board if desired.

Another advantage of the present invention is that the clip and printed circuit board meets the standards of the IEC 61215.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
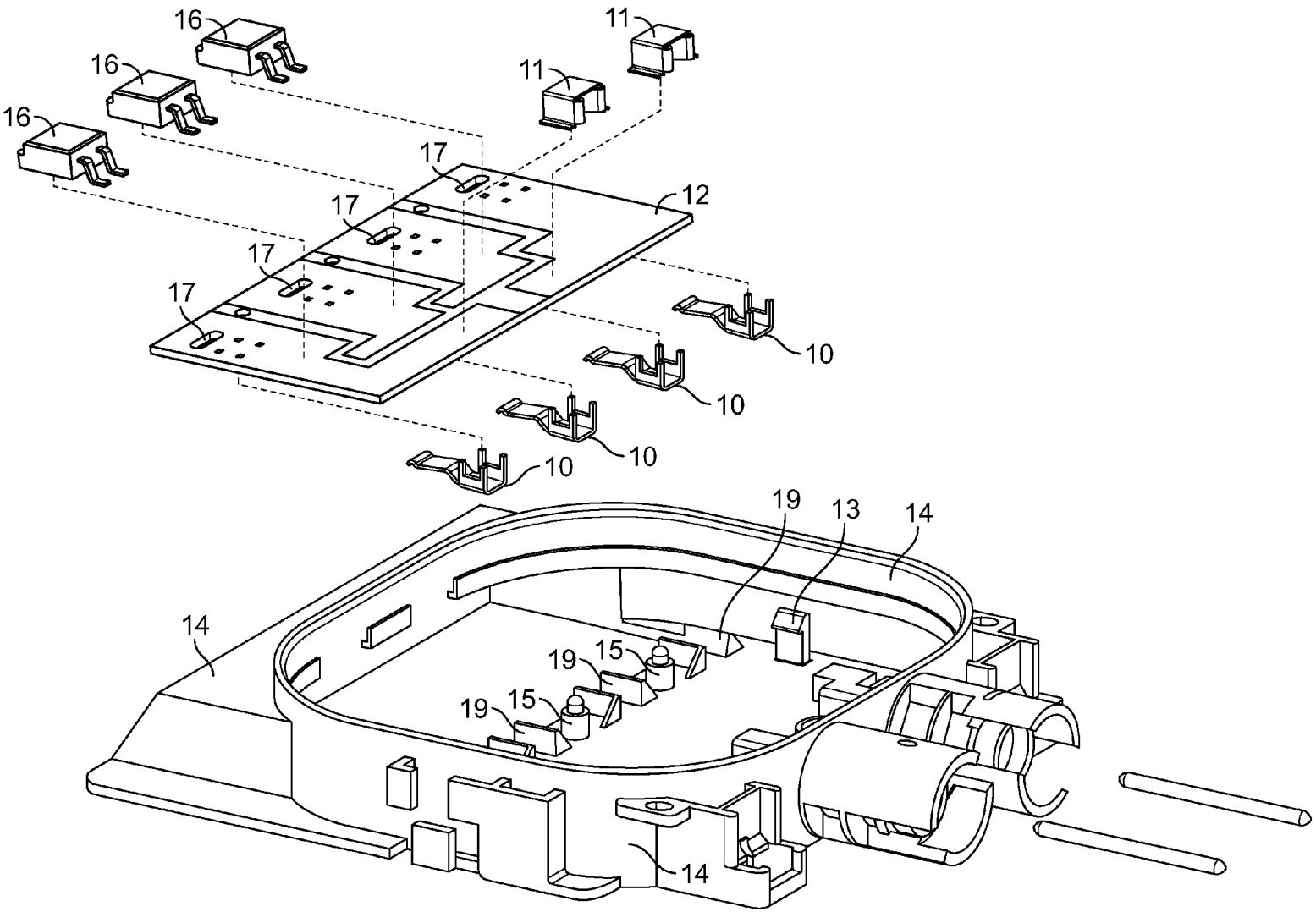
FIG. 1 is an exploded view of the present invention.

The present invention is directed to a printed circuit board with a spring clip mount assembly that meets the temperature requirements of the IEC 61215, and reduces the normal forces sustained by the circuit board and components during insertion of the wire tabbing into the junction box. FIG. 1 is an exploded view of the present invention showing the power interface contacts 11 that direct power to the PV power grid (not shown), the diodes 16 that are part of the electric circuitry on the printed circuit board 12, the printed circuit board 12 and spring clips 10 that receive wire tabbing into the junction box 14 where power from the solar cells enters. The junction box 14 can be constructed of a substantially rigid non-conductive material suitable to receive a printed circuit board 12, such as an ABS plastic or other suitable material. The power interface contact 11, diodes 16 and other electrical components (not shown for simplicity of the drawing) are secured to the printed circuit board 12 with surface mount technology, solder connections, or any other suitable connection. The solder connection used can be a wave-solder connection or any other suitable solder connection. The spring clips 10 are secured to the printed circuit board with a solderless connection. FIG. 1 shows a four position junction box 14 for receiving the printed circuit board 12 with mounted components 10, 11, 16, however, it is to be understood that a junction box 14 with one or more positions can be used for the present invention. The printed circuit board 12 is modified with the number of spring clips 10 and diodes 16 mounted thereon, depending upon the number of positions on the junction box 14. For example, a junction box 14 with two positions would have a printed circuit board 12 with two spring clips 10 mounted thereon. The printed circuit board 12 is coated with a sufficient amount, preferably a minimum of two ounces of copper or a copper alloy on both sides. However, any other type of conductive metal may be used. The system also includes the printed circuit board 12 having diodes with integral heat sinks as part of the cathodes to help dissipate heat within the junction box to meet the temperature standard of the IEC 61215.

The diode circuitry used with the present invention can be TO-220 packaged diodes 16. The TO-220 packaged diodes 16 contain heat sinks that assist with dissipating heat and help to meet the temperature standard of IEC 61215. The present invention may also use ITO-220AC diodes that have plastic covered heat sinks and help to dissipate any generated heat to meet the IEC 61215. In addition to the TO-220 diode and ITO-220AC diode, any other similar and suitable diode that can meet the IEC 61215 standard may be used with the present invention.

FIG. 1 also shows the posts 15 and latches 13 in the junction box 14 that secure the printed circuit board 12 in place when inserted. The printed circuit board 12 has apertures 17 that receive the junction box posts 15 when lowered into place. As the printed circuit board 12 is lowered into the junction box 14, the posts 15 slide through the circuit board apertures 17. The posts 15 are configured to securely prevent movement of the printed circuit board 12 once it is in placed in the junction box 14. The latches 13 are configured such that the printed circuit board 12 is lowered past the latch 13 in one direction and a portion of the latch 13 overhangs the circuit board 12 to prevent the board 12 from moving in the opposite direction out of the junction box 14. The latch 13 can be released without the aid of a tool or utensil to free the printed circuit board 12 from the junction box 14. Alternately, the latch 13 can be designed such that the use of a tool or utensil is required for release to free the printed circuit board 12 from the junction box 14. With either design, the posts 15 and latches 13 prevent the circuit board 12 from moving substantially in any direction when disposed and secured in the junction box 14. The posts 15 and latches 13 may be constructed of the same material, such as ABS plastic or any other suitable material, as the junction box 14 and can be of unitary construction with the junction box 14 as well.

In addition to the posts 15 and latches 13, the junction box 14 also contains supports 19 that provide support for the printed circuit board 12 when the printed circuit board 12 is secured in place by the posts 15 and latches 13 in the junction box 14. The supports 19 may be constructed of the same material as the junction box 14, the posts 15 and latches 13. The spacers 19 can be of unitary construction with the junction box 14. The supports 19 provide a stable foundation for the printed circuit board 12 to rest upon in the junction box 12 when secured by the posts 15 and latches 13.

Figure 2A:
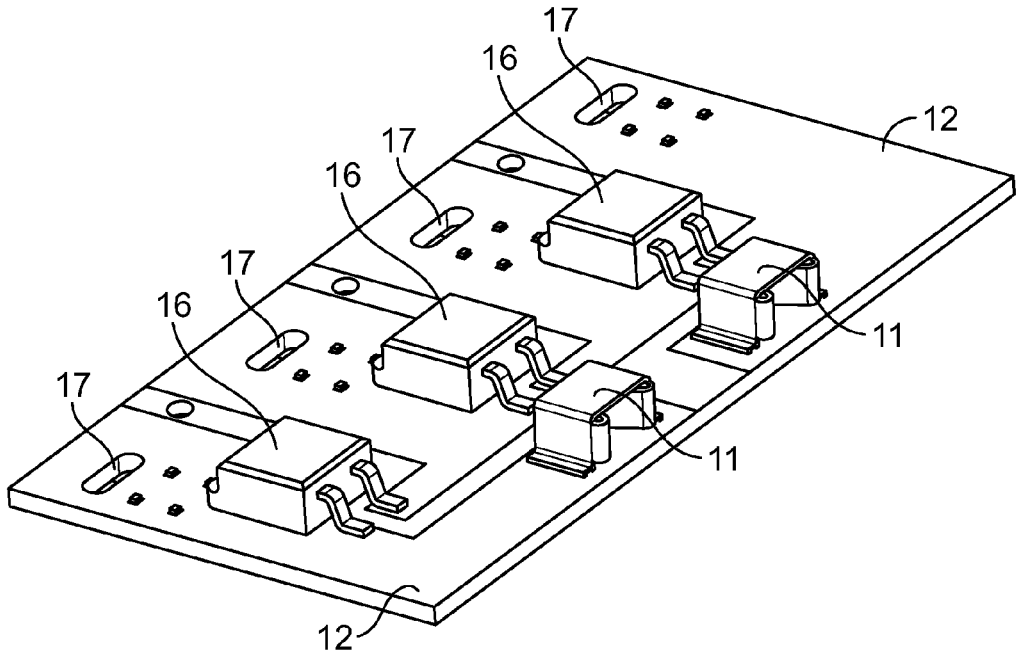
FIG. 2A is an illustration of the top view of the printed circuit board.
Figure 2B:
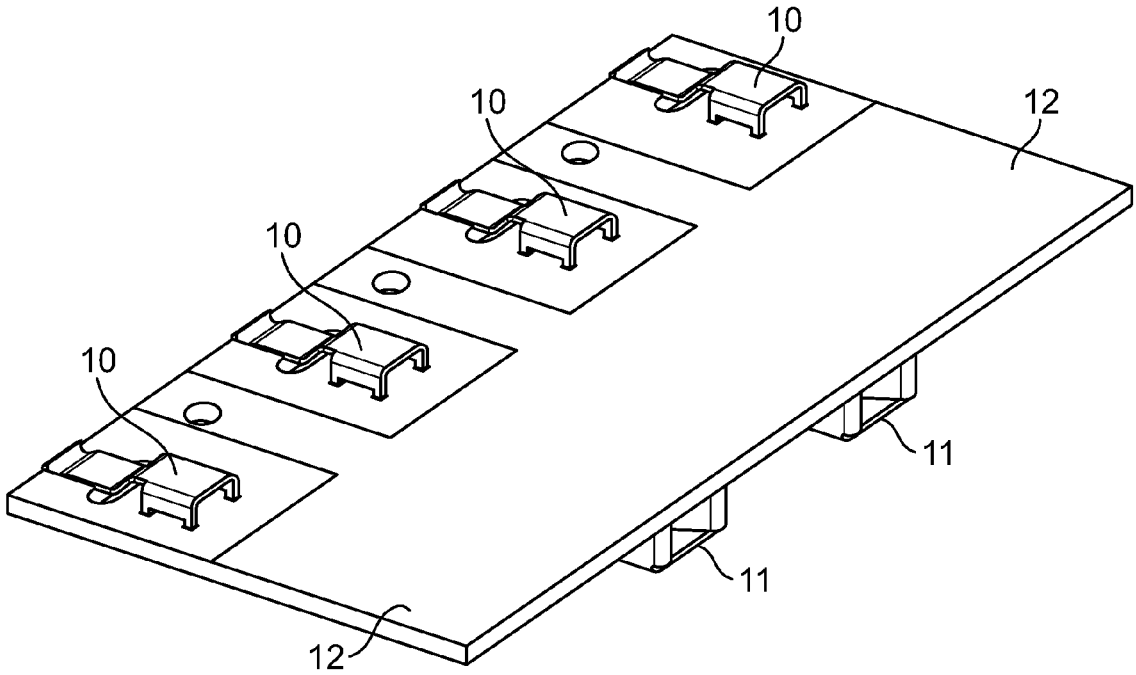
FIG. 2B is an illustration of the bottom view of the printed circuit board.

FIGS. 2A and 2B illustrate the printed circuit board 12 more specifically. FIG. 2A shows the top view of the printed circuit board 12 with the diodes 16 and contacts 11 mounted thereon. The diodes 16 have their own larger heat sinks, which help to dissipate heat and helps to meet the IEC 61215. FIG. 2B shows the bottom of the printed circuit board 12 where the spring clips 10 are surface mounted with a solderless connection (See FIGS. 3A, 3C and 3D).

Figure 3A:
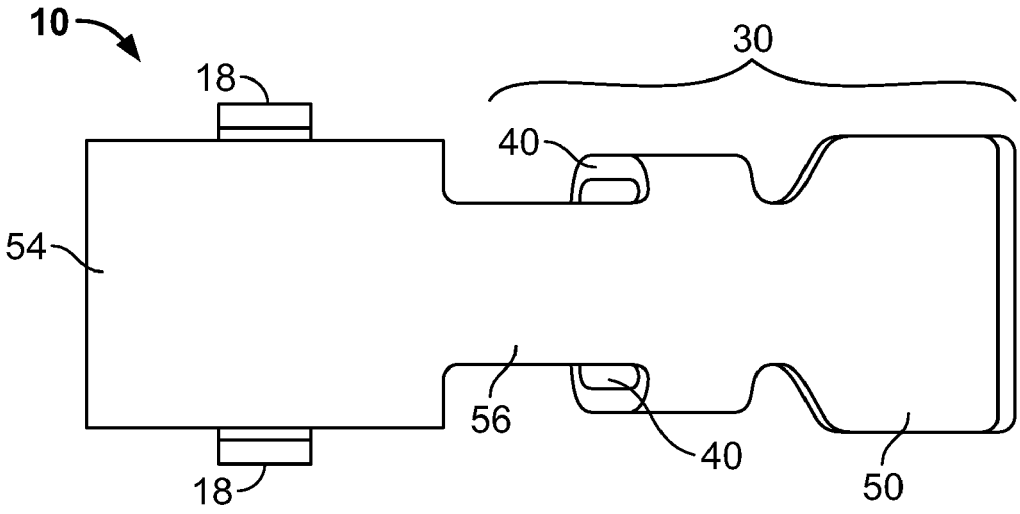
FIG. 3A illustrates a top view of the present invention.
Figure 3B:
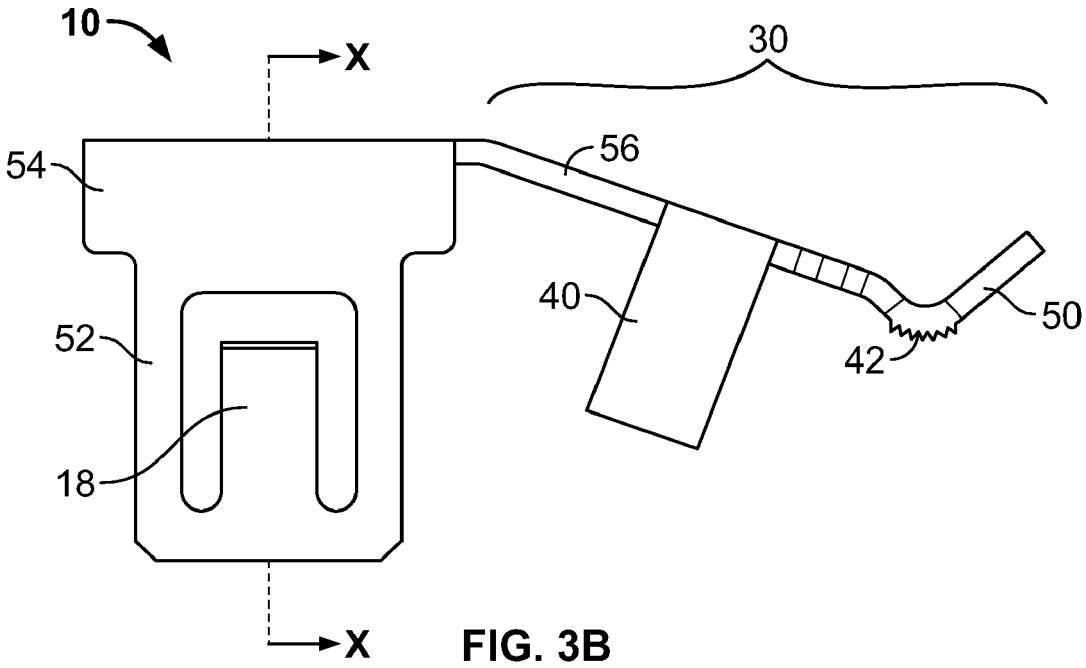
FIG. 3B illustrates a side view of the present invention.

FIGS. 3A, 3B, 3C, 3D and 3E illustrate various views of the spring clip 10 used in the present invention. As shown in FIGS. 3A and 3B, the spring clip 10 includes two generally upstanding wall sections 52 that extend perpendicular and upward from the base 51 to form parallel opposite walls. Each wall section 52 has a fastener 18 that secures the clip 10 to the printed circuit board 12. Connected on the ends of the wall sections 52 and perpendicular to the wall sections 52, a top section 54 extends and spans the distance between both wall sections 52. The wall sections 52 and top section 54 form a "U" shaped structure, having three defined areas connecting to form partially open space. Extending from the top section 54, a lance 30 contains two portions, a stem 56 and an elbow portion 50. The stem 56 extends from the top section 54 at an angle such that the stem 56 is not substantially parallel to the top section 54. Extending from the stem 56 are two release brackets 40 that are disposed substantially perpendicular to the stem 56. The ends of the brackets 40 are bent inward toward each other and rest substantially parallel to the stem 56. The elbow portion 50 is an arcuate shape that bends at a substantially opposite angle from the stem 56. The bottom side of the elbow 50 has serrations 42 to provide friction for holding any wire tabbing (not shown) that is inserted into the clip 10. The spring clip 10 can be constructed of copper, a copper alloy, plated steel or stainless steel, or any other suitable material that is electrically conductive, substantially flexible to accept an insert, while being substantially sturdy and rigid to provide retention when force is applied. The alloy may be of thickness of about 0.35 mm thick, but can be constructed with any thickness suitable for the clip 10 to operate correctly with the required retention.

FIG. 3A illustrates a top view of the top of the spring clip assembly 10. The fasteners 18 are shown extending from each of the wall sections (not shown). The fasteners 18 allow the printed circuit board (not shown) to pass without exaggerated force. As the board passes the fasteners 18, the fasteners 18 deflect toward the wall sections 52. Once the board passes the fasteners 18, the fasteners 18 move into their final positions and secure the clip 10 to the board 12. The clip 10 cannot be released unless a tool or utensil is used to depress the fasteners 18. Alternatively, manually depressing the fasteners 18 without the aid of tools or utensils will also release the clip 10 from the board 12.

FIG. 3B illustrates a side view of the clip 10. The bracket 40 extending from the stem 56 is used to release the wire tabbing (not shown) from the lance 30. The elbow 50 of the lance 30 exerts a force against the wire tabbing to secure it in place. The serrations 42 add a frictional element, which, in addition to the force exerted by the lance 30, provides a secure hold on any wire tabbing that is inserted into the clip 10. A tool, utensil, or any manual application may be used to depress the bracket 40, thereby displacing the stem 56 to a more substantially parallel angle to the top portion 54 of the clip 10. This releases the force of the elbow 50 on the wire tabbing and allows the wire tabbing to be removed from the clip 10.

Figure 3C:
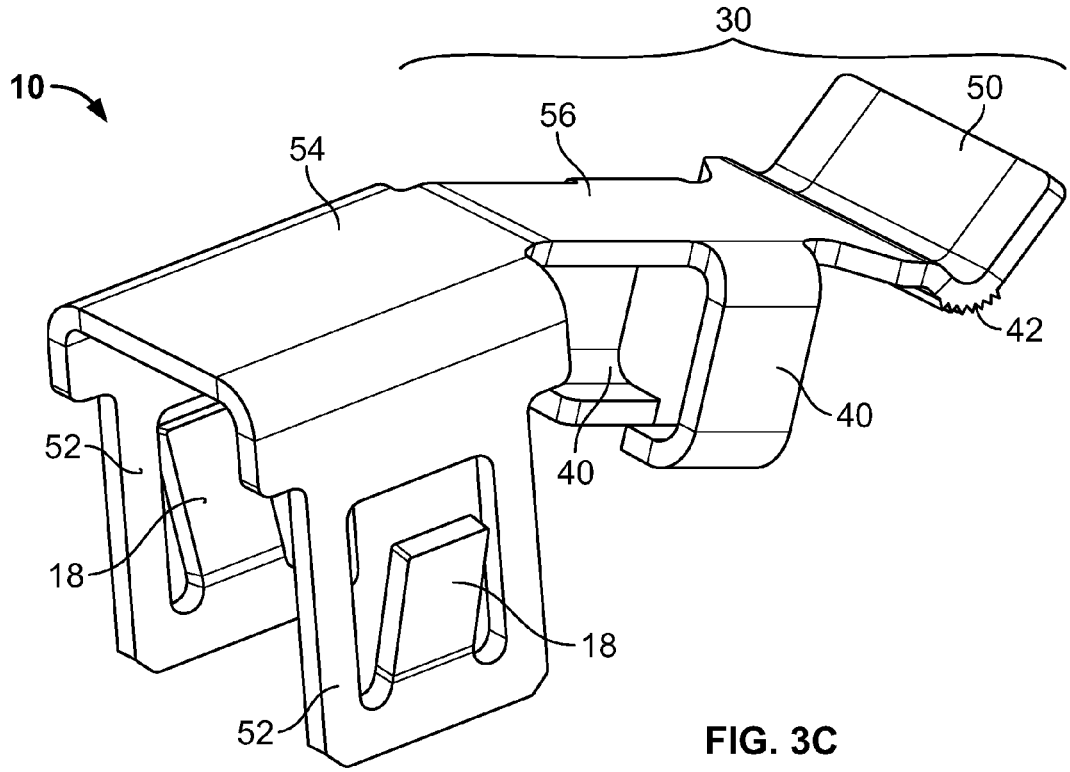
FIG. 3C illustrates a prospective view of the top of the present invention.
Figure 3D:
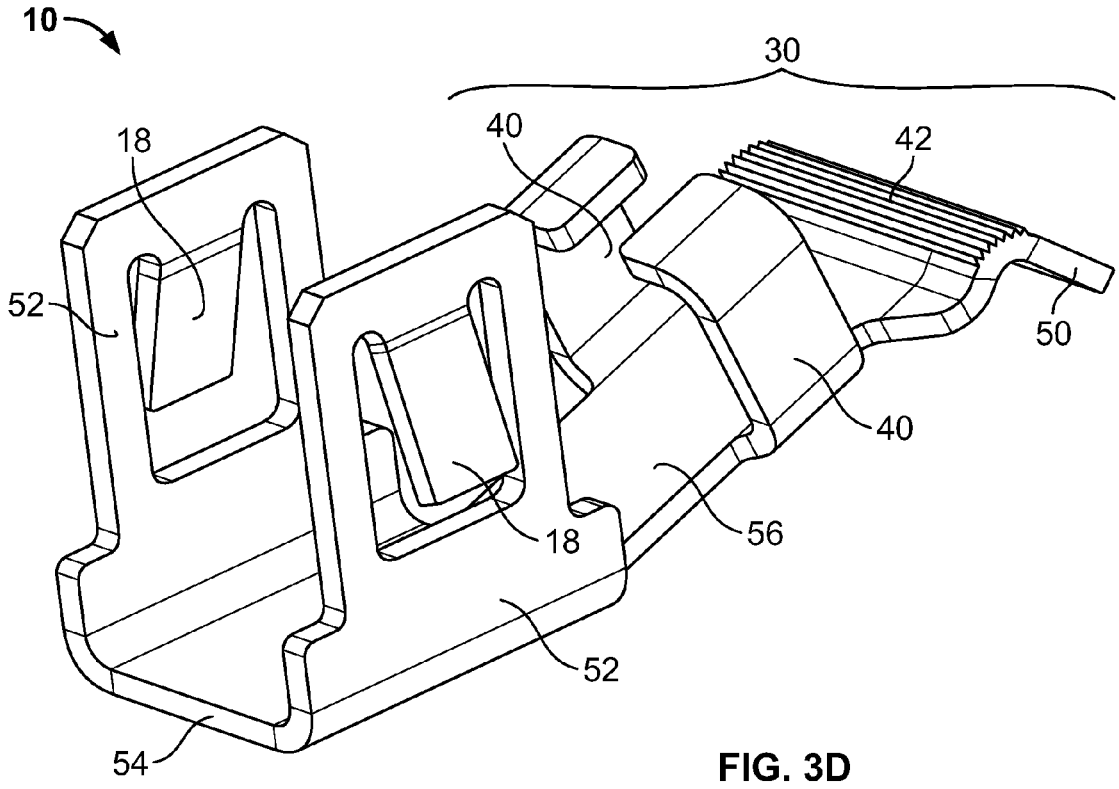
FIG. 3D illustrates a prospective view of the bottom of the present invention.

FIGS. 3C and 3D illustrate prospective views of the present invention. The wall sections 52 are shown, along with the fasteners 18 that secure the clip 10 to the printed circuit board (not shown). The angle of the fasteners 18 is shown such that they extend at an angle away from the wall sections 52. As the printed circuit board (not shown) passes the fasteners 18, the bracket displaces in toward the wall section 52, creating a substantially flat surface with the wall section 52. Once the printed circuit board completely passes the fasteners 18, the fasteners 18 return to the angle away from the wall section 52. This angle creates a ledge that secures the clip 10 to the printed circuit board. The printed circuit board cannot be moved past the fasteners 18 in the opposite direction unless a tool or utensil or a manual action depresses the fasteners 18 in toward the wall section 52 and creates the substantially flat surface for the printed circuit board to pass by. The action of depressing the fasteners 18 to secure the clip 10 to the printed circuit board is very quick and requires much less time and effort than a solder, weld or any other type or semi-permanent connection. In addition, the removal of the clip 10 with the fasteners 18 is much cheaper than the removal of a clip with a semi-permanent connection to the printed circuit board because of the reduced time and materials required.

Figure 3E:
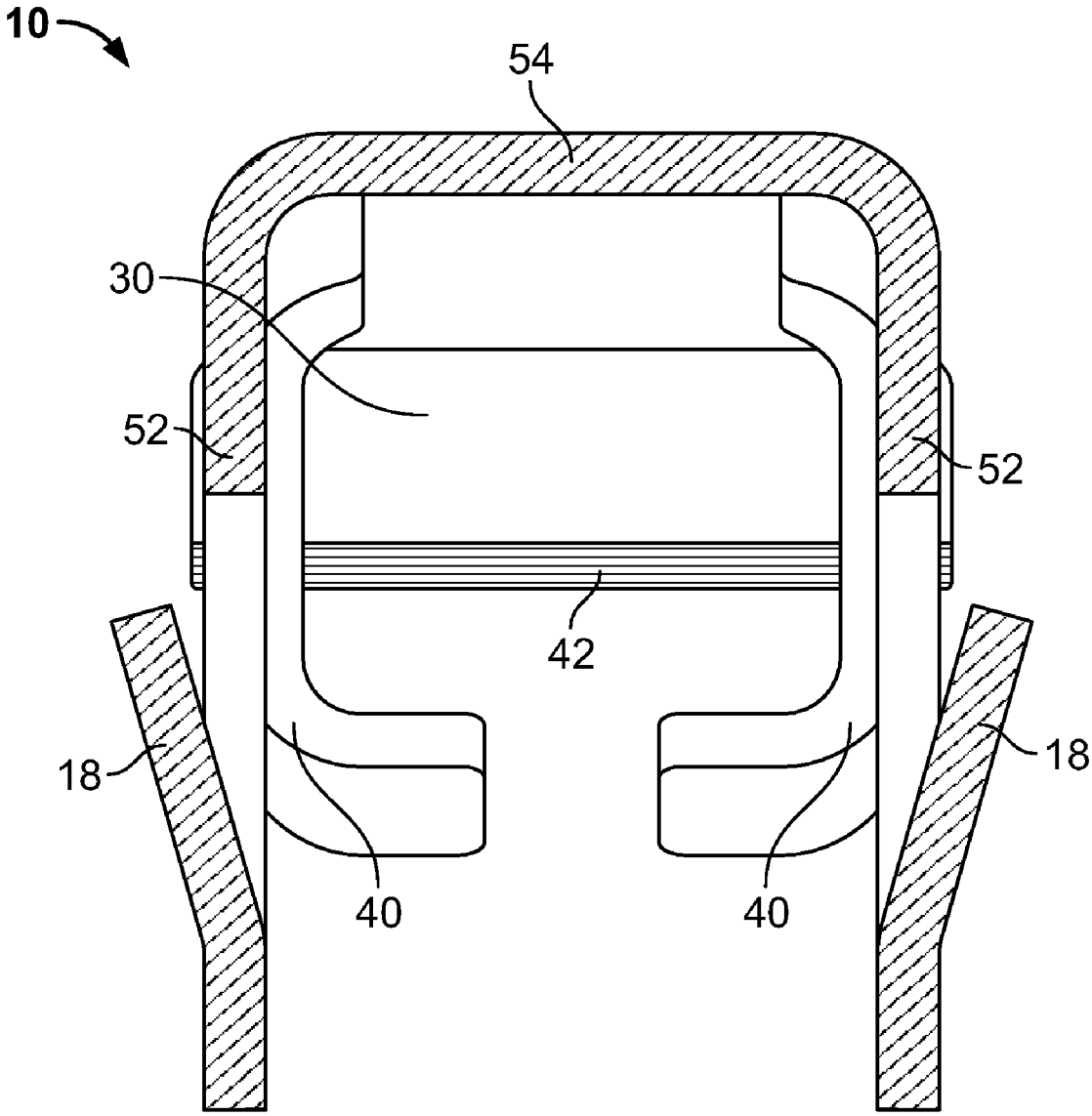
FIG. 3E illustrates a cross sectional view X-X from FIG. 3AB of the clip of the present invention.

FIG. 3E illustrates a cross sectional view of the spring clip 10 of FIG. 3B. The shape of the bracket 40 is shown, where the bracket 40 extends substantially perpendicular from the stem 56 (FIG. 3B) and curves inward toward the other bracket 40, without actually contacting the other bracket 40. FIG. 3E also illustrate the angle of the fastener 18 extending from the wall sections 52.

Figure 4:
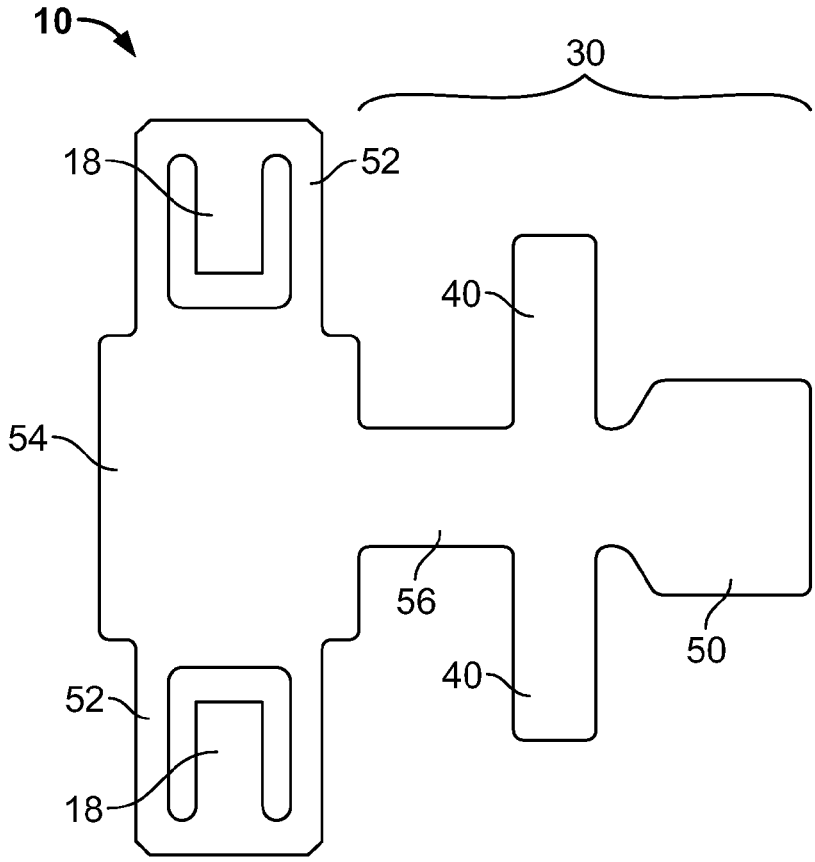
FIG. 4 illustrates a surface area view of the present invention.

FIG. 4 illustrates a surface area view of the stamped clip 10. The clip 10 is stamped from one unitary piece of material, such as stainless steel, copper, or other metallic or conductive material. The stamped piece is then bent into the shape necessary to function as a clip 10 to secure the wire tabbing in place and to secure the clip 10 to the printed circuit board with a solderless connection.

Figure 5:
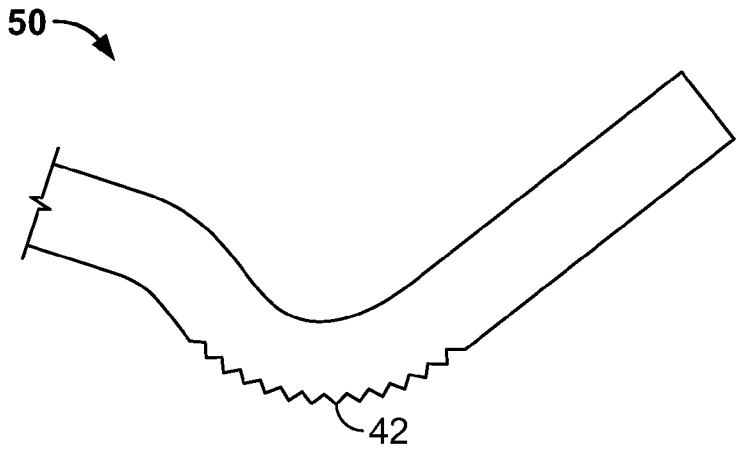
FIG. 5 illustrates the arcuate portion of the lance of the present invention.

FIG. 5 illustrates the elbow 50 of the lance 30. The elbow 50 is disposed at about a one hundred and twenty degree angle, with the outside angle where the serrated portions 42 are disposed resting at a 90 degree ±5 degrees. The serrations 42 are typically, but not limited to, 0.05 to 0.10 inches deep, and the entire elbow 50 portion of the lance 30 is typically, but not limited to, approximately 2 millimeters high from the edge of the serrations 42 to the top of the lance 30.

Figure 6A:
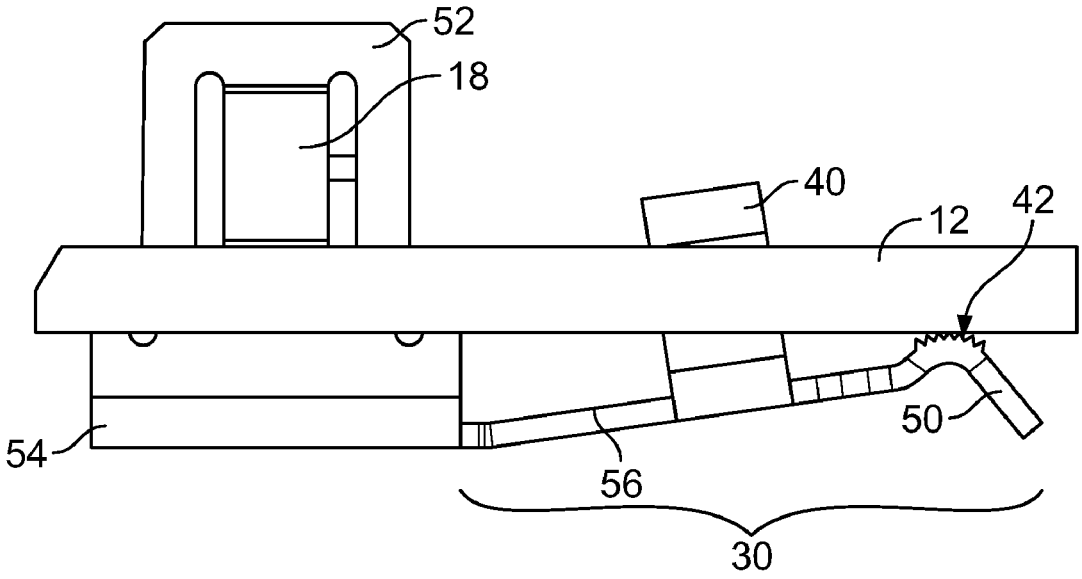
FIG. 6A is an illustration of how the present invention is inserted into the printed circuit board.

FIG. 6A illustrates how the clip 10 is inserted into the printed circuit board 12 without a solder connection. FIG. 6 illustrates the fasteners 18 and wall sections 52 as already placed through the printed circuit board 12 and securing the clip 10 to the board 12. The fasteners 18 are deflected into their original positions where the fasteners 18 rest on the board 12 and create the secure connection. The clip 10 cannot be removed from the board 12 unless the fasteners 18 are pressed inward to allow the wall sections 52 to pass through the board 12 without the fasteners 18 catching. The lance 30 is shown disposed below the printed circuit board 12, where the serrated edge 42 of the elbow 50 of the lance 30 is making contact with the board 12. Once wire tabbing is inserted between the clip 10 and the printed circuit board 12, the lance 30 exerts a normal force on the wire tabbing and the serrated edge 42 creates friction to securely hold the tabbing in place. The brackets 40 are shown as protruding above the printed circuit board 12. To release the wire tabbing (not shown) secured by the clip 10, these brackets are depressed toward the printed circuit board 12, thereby causing the lance 30 to move downward and away from the circuit board 12. The lance 30 moving downward and away from the board 12 causes a gap to form, and releases the normal force and friction force of the serrated edge 42 on the wire tabbing (not shown) and allows the wire tabbing to be removed from the clip 10.

Figure 6B:
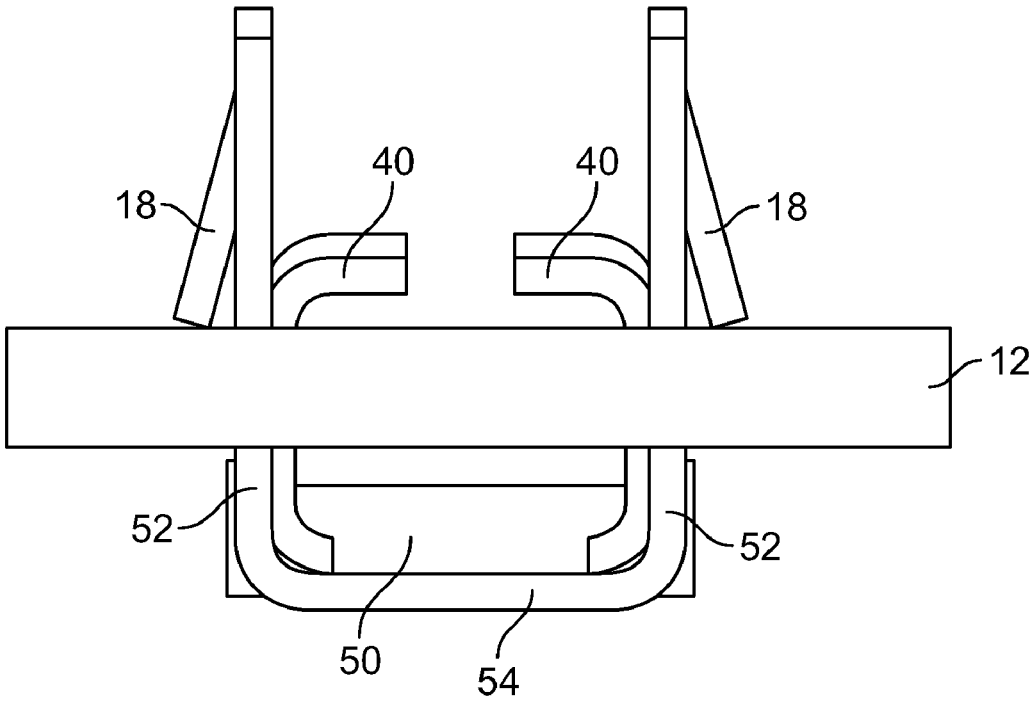
FIG. 6B is a front view of the present invention inserted into the printed circuit board.

FIG. 6B shows a front view of the clip 10 when secured in the printed circuit board 12. The fasteners 18 are shown, extending outwardly from the wall sections 52 to secure the clip 10 to the board 12 without the use of tools, soldering or any other permanent connection. The fasteners 18 are depressed inwardly toward the wall sections 52, creating a flat surface that slides through an aperture (not shown) in the board 12, allowing the clip 10 to be removed from the board 12. The fasteners 18 can be depressed manually, or with the aid of a tool or other utensil.

The clip 10 and printed circuit board 12 with the diodes 16 provides an assembly that is cheaper to manufacture and assembly, as well as providing reduced replacement time and expenses. The diodes used for this assembly provide better heat sinking capabilities that allow the electronics mounted on the circuit board to cool quicker than current systems and meets the new IEC 61215 standard. In addition, the clip 10 helps to reduce the normal forces applied to the board 12 during insertion of wire tabbing by absorbing most of that force through the clip 10. The clip 10 also provides better retention of the wire tabbing once inserted.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A connector assembly for receiving an electrical cable having a conductive protrusion comprising:

a plurality of wall sections, the wall sections being substantially parallel to one another and having a plurality of fasteners extending at an angle form the wall sections and configured to fixedly secure a printed circuit board or electrical component;

a top section substantially perpendicular to the plurality of wall sections and extending between the plurality of wall sections;

a lance having a stem portion extending from the top section and an elbow portion extending from the stem portion having a outward surface and an inward surface;

a plurality of brackets extending substantially perpendicular from the stem portion of the lance configured to displace the lance when a force is applied to the brackets;

a gap disposed above the elbow portion having a predetermined size configured to receive the electrical protrusion; and wherein the lance moves upon insertion of the conductive protrusion into the gap to create an electrical connection between the lance and the conductive protrusion.

2. The connector assembly of claim 1 wherein the protrusion is manually inserted into the connector assembly without the aid of a tool, utensil or an additional device.

3. The connector assembly of claim 2 wherein the protrusion is secured until the plurality of brackets are depressed.

4. The connector assembly of claim 3 wherein the plurality of brackets are depressed manually.

5. The connector assembly of claim 3 wherein the plurality of brackets are depressed with a tool or utensil.

6. The connector assembly of claim 2 wherein the elbow portion has an inner edge and an outer edge and wherein the outer edge has a serrated surface.

7. The connector assembly of claim 2 wherein the plurality of wall sections move through the printed circuit board to make a secure connection.

8. The connector assembly of claim 7 wherein the plurality of fasteners are disposed at an angle protruding away from the plurality of wall sections, and wherein the plurality of fasteners displace inward toward the plurality of wall sections when moving through the printed circuit board and displace outward when completely through the printed circuit board.

9. The connector assembly of claim 8 wherein the plurality of fasteners are displaced inward to remove the wall sections from the printed circuit board.

10. The connector assembly of claim 9 wherein the plurality of fasteners are displaced inward manually.

11. The connector assembly of claim 9 wherein the plurality of fasteners are displaced inward by a tool or utensil.

12. A printed circuit board assembly connecting arrangement comprising:

a plurality of diodes assembled to a printed circuit board;

a plurality of power interface components being configured to supply power to the printed circuit board arrangement and assembled to the printed circuit board;

a plurality of connector assemblies wherein each connector assembly of the plurality of connector assemblies further comprises;

a plurality of wall sections, the wall sections being substantially parallel to one another and having a plurality of fasteners extending at an angle form the wall sections and configured to fixedly secure a printed circuit board or electrical component;

a top section substantially perpendicular to the plurality of wall sections and extending between the plurality of wall sections;

a lance having a stem portion extending from the top section and an elbow portion extending from the stem portion having a outward surface and an inward surface;

a plurality of brackets extending substantially perpendicular from the stem portion of the lance configured to displace the lance when a force is applied to the brackets;

a gap disposed above the elbow portion having a predetermined size configured to receive the electrical protrusion; and wherein the lance moves upon insertion of the conductive protrusion into the gap to create an electrical connection between the lance and the conductive protrusion; and wherein the plurality of connector assemblies, the plurality of diodes and the plurality of power interface components are connected by an electric circuit arrangement and the connector assemblies.

13. The printed circuit board of claim 12 wherein the diodes are configured with heat dissipation capabilities.

14. A junction box assembly comprising;

a plurality of connector assemblies wherein each connector assembly of the plurality of connector assemblies further comprises;

a plurality of wall sections, the wall sections being substantially parallel to one another and having a plurality of fasteners extending at an angle form the wall sections and configured to fixedly secure a printed circuit board or electrical component;

a top section substantially perpendicular to the plurality of wall sections and extending between the plurality of wall sections;

a lance having a stem portion extending from the top section and an elbow portion extending from the stem portion having a outward surface and an inward surface;

a plurality of brackets extending substantially perpendicular from the stem portion of the lance configured to displace the lance when a force is applied to the brackets;

a gap disposed above the elbow portion having a predetermined size configured to receive the electrical protrusion; and wherein the lance moves upon insertion of the conductive protrusion into the gap to create an electrical connection between the lance and the conductive protrusion;

a printed circuit board arrangement, wherein the printed circuit board arrangement further comprises;

a plurality of diodes;

a plurality of power interface components being configured to supply power to the printed circuit board arrangement;

wherein the plurality of connector assemblies, the plurality of diodes and the plurality of power interface components are secured to a printed circuit board and connected by an electric circuit arrangement and the connector assemblies; and wherein the plurality of connector assemblies, the plurality of diodes and the plurality of power interface components are connected by an electric circuit arrangement and the connector assemblies.

15. The junction box of claim 14 further comprising a plurality of securing devices, the securing devices being configured to substantially secure the printed circuit board in place.

16. The junction box of claim 14 wherein at least one diode of the plurality of diodes is a TO-220 packaged diode.

17. The junction box of claim 14 wherein at least one diode of the plurality of diodes is an ITO-220AC diode.

* * * * *